United States Patent [19]

Gleeson

[11] 4,353,190

[45] Oct. 12, 1982

[54] STIFFENED ELONGATE SUPPORT MEMBER

[76] Inventor: Maurice J. Gleeson, P.O. Box 663, Honeydew 2040, Transvaal, South Africa

[21] Appl. No.: 152,304

[22] Filed: May 22, 1980

[30] Foreign Application Priority Data

Mar. 2, 1979 [ZA] South Africa ..... 79/0991

[51] Int. Cl.[3] ..... E04C 3/10

[52] U.S. Cl. ..... 52/226; 52/641; 52/691; 52/695; 14/10; 14/17

[58] Field of Search ..... 52/225, 226, 691, 644, 52/641, 695; 14/17, 10, 11

[56] References Cited

U.S. PATENT DOCUMENTS

| | | | |
|---|---|---|---|
| 1,009,996 | 11/1911 | Rifflard | 52/226 |
| 2,653,553 | 9/1953 | Jacobs | 52/641 |
| 2,704,522 | 3/1955 | Frieder et al. | 52/644 X |
| 2,986,246 | 5/1961 | Lester | 52/640 X |
| 4,129,915 | 12/1978 | Abell | 52/225 X |

FOREIGN PATENT DOCUMENTS

| | | | |
|---|---|---|---|
| 7606797 | 12/1976 | Netherlands | 14/10 |

*Primary Examiner*—Carl D. Friedman

*Attorney, Agent, or Firm*—Hubbell, Cohen, Stiefel & Gross

[57] ABSTRACT

An elongate support member of the type generally used to span a pair of horizontally spaced supports is stiffened by pivotally attaching thereto at spaced points along its length at least two posts which extend in the same general direction and generally transverse to the length of the support member, and by pivotally attaching tension members or ties to a point at or near each end of said member and the free end of the nearer post and from at or near the free end of a post to the pivotal connection of the next adjacent post to the member, whereby the tension members or ties cross each other between adjacent posts. This form of stiffening allows bending moments and deflections arising as the result of loads applied to the member to be reduced and rendered positive.

9 Claims, 7 Drawing Figures

PRIOR ART

STIFFENED ELONGATE SUPPORT MEMBER

Figure 1:
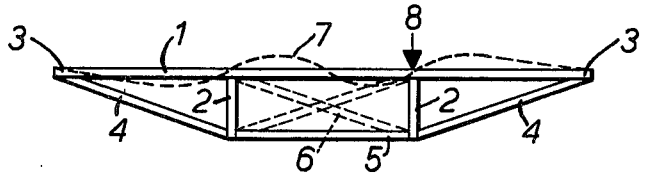

This invention relates to stiffened elongate support members of the type which are generally used to span the distance between a pair of horizontally spaced supports which are generally located so as to support the member at at least two points along the length thereof.

While the present elongated support member must be supported at at least two horizontally spaced positions, it is to be understood that the support member may be a cantilevered support member which, in effect, has two positions at which it is supported, albeit one of them is a downward reaction acting on the anchored end of the support member.

The support members with which the present invention is concerned include, but are not limited to generally horizontal extending beams, girders, booms and the like which can be used to support any load as may be required and, for example, which may be utilised as support members for temporary or permanent bridges. The support members also include slender or other arches which may be fixed, or of either the two pin or three pin configuration as well as horizontally extending purlins or other roof supporting members.

BRIEF DESCRIPTION OF THE PRIOR ART

It is well known that beams, arches and other generally horizontally extending support members can be stiffened by means of various combinations of posts, braces, tension members and the like. One very common structure is a generally straight, horizontally extending, beam which has a pair of posts extending downwardly from two spaced positions located each at about one third of the length of the beam away from the adjacent end thereof. These posts are generally rigidly fixed, such as by bolting, riveting, welding or the like, to the beam, and have their lower free ends interconnected by a horizontal brace and tie arrangement and also their free ends are interconnected by means of suitable ties to the beam itself adjacent the free end thereof. This type of stiffened beam is successful to a certain degree but does give rise to moments of force being imparted to the beam where the posts are connected thereto. Also the posts are, of course, subjected to a bending moment when an unsymmetrical load is supported by the beam and such unsymmetrical loads are extremely common where the beams are used as supports for bridges for example, where a moving load traverses the length of the beam.

Similar arrangements have been proposed where the support member is in the form of a two or three pin arch of the type generally regarded as suitable for supporting a roof covering of some form or other. In the case of an arch various rigid posts and tie arrangements have been proposed and in fact a tie arrangement including a swivel plate adapted to distribute the tension loads between the ties has been proposed.

Surprising results have now been obtained with a particular configuration of ties and posts which results in a particularly advantageous stiffening effect giving rise to very little, if any, upward deflection of a region of the elongate support member which is free of any unsymmetrical load.

It is accordingly an object of this invention to provide an elongate support member of the general type described above which is stiffened in a particularly advantageous, and inexpensive, manner.

BRIEF DESCRIPTION OF THE INVENTION

According to the present invention there is provided an elongate support member, wherein the support member has pivotally attached thereto at spaced points along its length at least two posts extending in the same general direction and generally transverse to the length of the support member, and wherein tension members or ties are pivotally attached to and extend between a point at or near each end of said member and the free end of the near post and from at or near the free end of a post to the pivotal connection of the next adjacent post to the member, whereby the tension members or ties cross each other between adjacent posts.

The present support members may be stiffened and strengthened with a reduction in mass, as compared with an unstiffened member and the bending moments arising as the result of applied loads, either distributed or non-symmetrical point loads, are reduced and are positive in all respects. Furthermore, the resulting deflections are positive and reduced, tests having shown that these may be about one sixth of those for a pure arch; horizontal reactions are also reduced.

If desired, the support member may comprise a beam of a bridge, in particular, a Bailey bridge, and such bridge may comprise a pair of laterally spaced beams utilised in conjunction with decking which is releasably secured to the spaced beams. In the case of a Bailey bridge, the beams can be composed of releasably interconnected lengths of box-section, in known manner, and the ties or tension members can also be made in lengths.

It will be understood that the support member could be of any suitable cross-sectional shape but in particular a Tee-section (as opposed to the conventially used I-section) will be preferred for the support member, whether the support member is in the form of a beam or an arch. The stem of the Tee-section, in each case, provides an eminently suitable flange for pivotal attachment of tension members or ties thereto as well as for the pivotal attachment of the posts. However, any other suitable sections, such as a channel-section, box-section, angle-section or the like can be utilised and as stated above, a box-section is preferred for a Bailey bridge.

Instead of a simple stiffening as indicated above, a more comprehensive stiffening can be provided if each section of the support member between an end thereof and the pivotal attachment of a post and/or between the pivotal attachments of adjacent posts has pivotally attached thereto at spaced points along its length two subsidiary posts, extending in the same general direction and generally transverse to said section, and if subsidiary tension members or ties are pivotally attached to and extend between a pivotal attachment of a main post or tie to the member and the free end of the nearer subsidiary post, and between the free end of such subsidiary post and the pivotal attachment of the adjacent subsidiary post to the member.

BRIEF DESCRIPTION OF THE DRAWINGS AND PREFERRED EMBODIMENT

Figure 2:
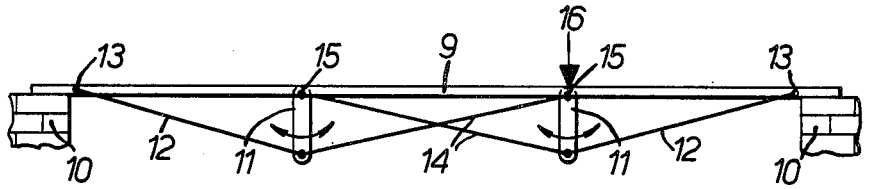
Figure 3:
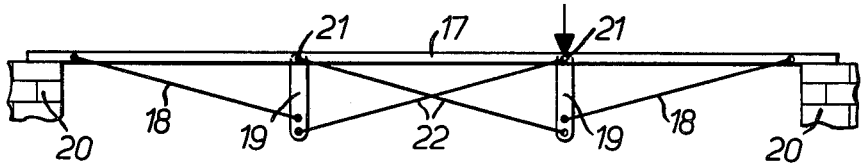
Figure 4:
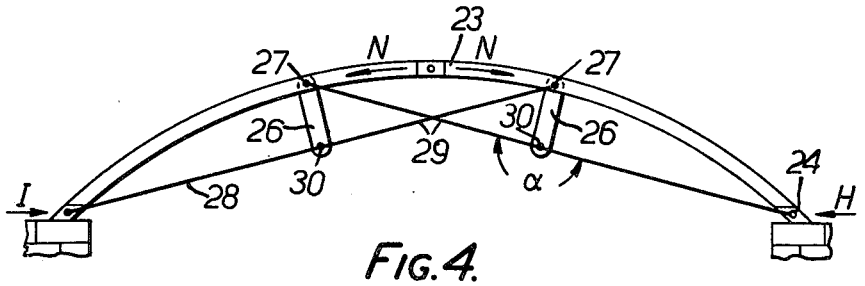
Figure 5:
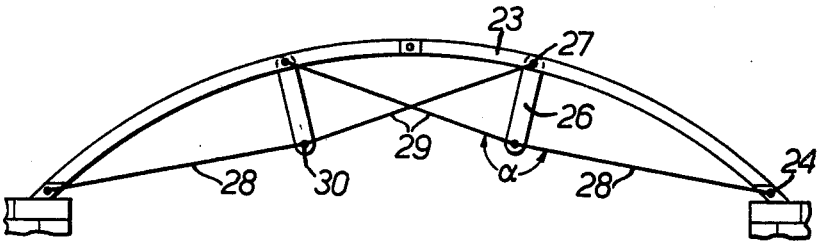
Figure 6:
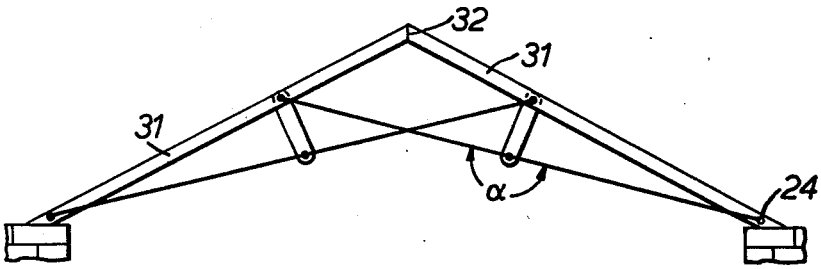
Figure 7:
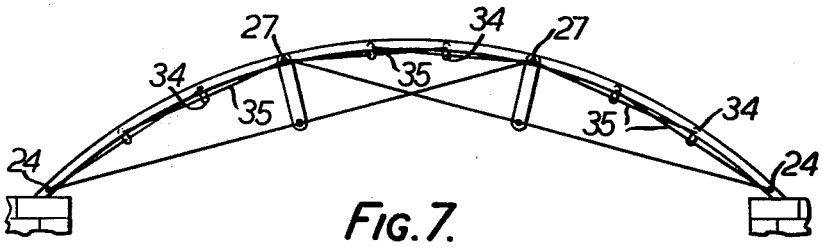

In order to enable the invention to be more readily understood, reference will now be made to the accompanying drawings, which illustrate diagrammatically and by way of example some embodiments thereof, and in which:

FIG. 1 is a schematic elevation of a horizontal beam stiffened in a conventional manner, FIGS. 2 and 3 are similar views of two different horizontal beams stiffened in accordance with the present invention, FIGS. 4 and 5 are similar views of two different arches stiffened in accordance with the present invention, FIG. 6 shows the stiffening of FIG. 4 applied to a different arch, and FIG. 7 is a schematic elevation of an arch with a more comprehensive form of stiffening.

Referring firstly to FIG. 1 which illustrates the prior art in connection with stiffened beams, there is shown a beam 1 which is stiffened by means of a pair of posts 2 extending downwardly at right angles to the beam and spaced roughly equally from each other and from the adjacent end 3 of the beam. The ends of the beam are connected to the lower ends of the posts by means of ties 4 and the lower ends of the posts are interconnected by further ties 5. Braces 6 can be provided as indicated by dotted lines in FIG. 1.

The posts are rigidly connected to the beams and ties, and this being so, any force which tends to urge the posts angularly relative to the beam will cause a moment to be exerted on the beam, and in fact, whilst being exaggerated, the beam will assume a shape substantially as indicated by dotted lines 7 when a force, as indicated by arrow 8, is exerted on the beam above one post. This is undesirable in that a reverse camber or controflexure is set up in the beam.

Referring now to FIG. 2 there is shown a beam 9 stiffened according to the present invention. The beam 9 is supported at each end thereof at 10 and has posts 11 hingedly attached to the beam at points approximately one third of the length from each end thereof with the two posts being spaced apart by a distance equal to one third of the length of the beam. This particular location is only a preferred one and the posts could be located in many other relative positions to satisfy a particular requirement. A tension member 12 is pivotally attached to the lower free end of each arm 11 and extends to a pivot point 13 adjacent the nearer end of the beam. A further tension member 14 extends from the lower end of each post 11 in criss-cross manner to the pivot point 15 whereby the other post is attached to the beam. Thus the two centrally located tension members 14 cross in the centre of the length of the beam and below the centre line of the beam.

A force, indicated by arrow 16, applied to the beam at a position directly above one post will not, in fact, give rise to a rippled effect of the length of the beam as in the case of the prior art beam illustrated in FIG. 1. In fact, tests conducted to date indicate that the entire beam is deflected downwardly but by a very small extent when compared to the prior art beam of the same construction.

In fact, tests conducted on a standard stiffened beam having a pre-tensioned set of ties as illustrated in FIG. 1 and with a set camber of 10 mm. gave, in some cases, a negative camber at positions removed from that where the force was applied. In other cases the deflections of the beam obtained were extremely high compared to those obtained when a beam according to the present invention was subjected to the same tests. Simply by way of example, a beam stiffened according to FIG. 1 gave a deflection under the loaded position at one of the posts of 8.6 mm. when a load of 106 g. was applied thereto. The same beam when stiffened according to FIG. 2 i.e. according to the present invention, gave a deflection of only 4.4 mm. at the same position under the same set of circumstances.

In the case of the beam 17 illustrated in FIG. 3, the ties 18 connecting the free ends of the arms 19 to the ends 20 of the beam, are connected to the posts at a position nearer the pivots 21 connecting the posts to the beams than are the ties 22 connecting the free ends of the arms 19 to the pivots 21. In this case, a deflection of only 4.1 mm. was obtained under the identical conditions referred to above. Various different positions of this nature could be used with a bridge beam having a variable effective length as a result of its being composed of a number of collinearly arranged lengths of beam-section. It is to be noted that it is considered best to maintain the angle of the tension members relative to the beam constant.

In all cases where beams were made according to this invention, there was no negative camber or contraflexure detected at all at any position along the length of the beam.

The invention is not solely applicable to beams but also applies to arches as illustrated in FIGS. 4 and 5. In the case of the arch of FIG. 4, the arch is an arch rib 23 which is pinned at springers 24 at the top of supports 25 which may be in the form of columns, beams, walls, abutments or piers. It is, however, not absolutely necessary for the arch to be so pinned. Posts 26 are hinged by pins 27 to the arch 23 at points which are a third of the span of the arch from the ends. Ties 28 are pinned between the springer pins 24 and pins 30 at the ends of the posts 26 and ties 29 are pinned between the pins 30 and the pins 27. It will be noted that the arrangement is such that, when the ties have been finally linked to the springers 24 using tension jacks or other means, each pair of ties 28, 29 lies along a straight line with the angle $\alpha$ between them being 180° with the ties 29 crossing one another below the top of the arch. The span of the arch will be the design length on completion of the linkage so that the stiffened arch as a unit is in equilibrium and ready for erection.

FIG. 5, in which the same reference numerals are used as in FIG. 4, shows a modification of the arch of FIG. 4 in which the pairs of ties 28, 29 are set so that the angle $\alpha$ is greater than 180°. With this arrangement, the arch rib can only be subjected to positive downward loading, but it has the advantage that it is able to carry a greater load or to give rise to a smaller horizontal reaction at the springers as compared with the arch shown in FIG. 4.

When a load is uniformly distributed over the entire span of an arch as shown in FIG. 4 or 5, the posts 26 deflect equally under the proportionate loading. The compression force in say the left hand post 26 deflects the associated pair of ties 28 and 29 with a resultant increase of stress equally in each tie because the post rotates about its pins at each end. The tie 28 reduces the horizontal reaction H and the tie 29 puts a load on the other post 26, at the same time reducing the rib thrust N at the pin 27 of the right hand post. The extra force thus placed on the right hand post 26 is now transferred to its associated pair of ties 28 and 29 and the stress in them is equalised because of the rotation of the post. The tie 28 pinned to the right hand post 26 reduces the horizontal reaction H at the right hand springer while the tie 29 places an extra load on the left hand post and thus equilibrium of the rib structure will automatically come about.

Before erection of the arch, the prestress in the ties 28 and 29 when they were finally connected in equilibrium put a compressive stress on the posts 26 causing an upward deflection of the rib 23 along its entire length, the deflection being greatest towards the centre and least towards the springers. For the arch shown in FIG. 4, the prestress design was such as to allow for a set amount of upward deflection so that the pairs of ties 28, 29 would lie at 180° to each other. In the case of the arch shown in FIG. 5, the prestress design was such that there would be upward deflection of the arch so that the ties would lie at an angle $\alpha$ of more than 180°.

It is the upward reaction of the posts induced by the compensating stresses which are induced by the loading of the posts and are carried from one post to the other by the balancing of the stresses in the ties, that causes a positive deflection across the arch being a fraction of the positive and negative deflections created in a pure arch of equal cross-section with similar loading.

The 180° arrangement of the ties shown in FIG. 4 is such that the arch can take an upward (negative) load, such as wind suction, on a roof. With an evenly distributed upward loading, which is unlikely, the ties go into further tension and each puts a greater load on the posts 26 thus reducing the upward loading proportionately.

With an uneven upward loading on one side of the roof, the ties pinned to the post on that side of the arch go into further tension and put a load on the other post, which in turn increases the tension in the other ties thus putting a load on the first post which has the resultant effect of reducing the upward wind load.

FIG. 6 is a view similar to FIG. 4 and accordingly the same reference numerals are used for like parts, the difference being that the arch is not a radiassed arch but consists of two rafters or beams 31 connected at 32 and hinged at springers 24. If desired, the angle $\alpha$ between the ties can be more than 180° as shown in FIG. 5.

Finally, FIG. 7 shows an arch similar to that shown in FIG. 4 but in which each section of arch rib between the pivotal points 24 and 27 for the posts and springers, is itself stiffened by subsidiary posts 34 and subsidiary ties 35. A similar arrangement of subsidiary posts and ties can also be applied to a beam such as shown in FIG. 2 or 3.

It will be understood that in all cases the tension members or ties are pre-tensioned in order to give effect to this invention. If they were not pretensioned the deflection would be much greater as a result of the fact that any free play would immediately be taken up simply by the beam deflecting.

Thus, it is proposed, in practice, to use jacks to pretension the tension members and, this being so, the tension members may be arranged to be placed under the desired tension when pivot holes can be aligned and pivot pins then knocked into the holes. This arrangement would be very practical where the beams, such as those described with reference to FIGS. 2 and 3, are utilised of the construction of temporary or permanent bridges in which case the correct tension will be present when the pivot holes are aligned so as to receive a pivot pin. In this manner no tension measuring device or apparatus will be required on site.

It is to be noted that the tension members will preferably be solid steel rods or tubes as opposed to stranded cables or the like. The reason for the preference of solid or tubular members over stranded tension members is that stranded tension members can vary in their tension as a result of variation of positioning of the various strands therein.

it is envisaged that a Bailey type of bridge can easily be constructed utilising a pair of spaced beams 9 or 17 as described with reference to FIGS. 2 or 3 respectively with the relevant decking used to interconnect the two laterally spaced beams in use. It has been found that bridge spans can be made lighter than heretofore utilising the invention thus giving advantages both in respect of cost and weight. Also, use of such beams for bridges has the added advantage that launching thereof in cantilever fashion is greatly facilitated. This results from the fact that posts can be swung around to extend upwardly and the tension members installed in position as described. In this case the beam is stiffened with regard to its own weight for cantilever launching. Cantilever beams may be stiffened in the same way. After launching the posts are swung down and the tension members reinstated under the beam.

In particular, the present M.G.M., military bridge in aluminium cannot be stiffened in conventional manner using posts and rope ties because negative deflection is encountered when a tank approaches the first post and passes over it. The bridge is designed to have two main beams made up of units which are pinned together with heavy pins on the bottom flange and only have light connecting pins on the top flange for erection and launching purposes. If the bridge has to be lengthened for carrying tanks then a second set of special units is fixed below the top beam. Using the present stiffening arrangement similar to that shown in FIG. 2, it is possible to adapt the bridge to carry the same load with positive deflection of the deck for any loading position, without the use of special units below the top beam, the pivotal connection and cross-ties ensuring no contraflexure of the deck when a tank passes over.

I claim:

1. An elongate support member, wherein the support member has pivotally attached thereto at spaced points along its length at least two posts extending in the same general direction and generally transverse to the length of the support member, and wherein tension members or ties are pivotally attached to and extend between a point at or near each end of said member and the free end of the nearer post and from at or near the free end of a post to the pivotal connection of the next adjacent post to the member, whereby the tension members or ties cross each other between adjacent posts.

2. A member as claimed in claim 1, wherein the member is in the form of a horizontally extending beam.

3. A member as claimed in claim 1, wherein the member is in the form of an arch.

4. A member as claimed in claim 3, wherein a tie extending between the end of the member and the free end of the post lies at an angle of 180° to the tie extending between the free end of said post and the pivotal connection of the adjacent post to the member.

5. A member as claimed in any one of claims 1, 2, 3, or 4 wherein the member is T-shape in cross-section.

6. A brdge comprising at least one elongate support member according to any one of claims 1, 2, 3, or 4.

7. A roof comprising at least one elongate support member according to any one of claims 1, 2, 3, or 4.

8. A member as claimed in any one of claims 1 to 4, wherein each section of the support member between an end therof and the pivotal attachment of a post and/or between the pivotal attachments of adjacent posts has pivotally attached thereto at spaced points along its length two subsidiary posts extending in the same general direction and generally transverse to said section and wherein tension members or ties are pivotally attached to and extend between a pivotal attachment of a main post or tie to the member and the free end of the nearer subsidiary post, and between the free end of such subsidiary post and the pivotal attachment of the adjacent subsidiary post to the member.

9. A member as claimed in claim 8 wherein the member is T-shaped in cross-section.

* * * * *

UNITED STATES PATENT AND TRADEMARK OFFICE

CERTIFICATE OF CORRECTION

PATENT NO. : 4,353,190

DATED : Oct. 12, 1982

INVENTOR(S) : Maurice J. Gleeson

It is certified that error appears in the above—identified patent and that said Letters Patent is hereby corrected as shown below:

Column 6, line 60: "brdge" should read --bridge--.

Signed and Sealed this

*Fourteenth* Day of *June 1983*

[SEAL]

*Attest:*

DONALD J. QUIGG

*Attesting Officer*

*Acting Commissioner of Patents and Trademarks*